US006379187B2

(12) United States Patent
Nishimatsu

(10) Patent No.: US 6,379,187 B2
(45) Date of Patent: Apr. 30, 2002

(54) ELECTRICAL CONNECTOR

(75) Inventor: Norimasa Nishimatsu, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/755,079

(22) Filed: Jan. 8, 2001

(30) Foreign Application Priority Data

Feb. 9, 2000 (JP) ..... 2000-031369

(51) Int. Cl.[7] ..... H01R 13/648

(52) U.S. Cl. ..... 439/607; 439/660; 439/924.1; 439/284

(58) Field of Search ..... 439/607, 284, 439/353, 660, 924.1, 680

(56) References Cited

U.S. PATENT DOCUMENTS 5,267,881 A * 12/1993 Matuzaki ..... 439/660
5,575,674 A * 11/1996 Davis et al. ..... 439/284
6,007,359 A * 12/1999 Kosmala ..... 439/607
6,007,379 A * 12/1999 Michaelis ..... 439/607
6,113,427 A * 9/2000 Wu ..... 439/607
6,146,210 A * 11/2000 Cha et al. ..... 439/680
6,190,208 B1 * 2/2001 Villain ..... 439/660
6,227,880 B1 * 5/2001 Zhu et al. ..... 439/607
6,290,540 B1 * 9/2001 Nishio et al. ..... 439/607

* cited by examiner

*Primary Examiner*—Tho D. Ta
(74) *Attorney, Agent, or Firm*—Kanesaka & Takeuchi

(57) ABSTRACT

An electrical connector comprises a housing with a plug section having a width greater than a height thereof and a plurality of contact elements (14) with contact sections (14A) arranged in the widthwise direction of the connector, a pair of guiding members or protruded section(18) or indented sections (44) provided on opposite sides of the connector.

5 Claims, 4 Drawing Sheets

ELECTRICAL CONNECTOR

BACKGROUND OF THE INVENTION

1. Field of the Invention

The present invention relates to electrical connectors and, particularly, to an electrical connector having a plurality of contact elements with contact sections arranged laterally.

2. Description of the Related Art

An electrical connector of this type is disclosed in Japanese patent application Kokai No. 11-505663. This connector comprises a housing with a plug section for plugging with a mating connector and a plurality of contact elements with contact sections arranged on the front face of the plug section in the widthwise direction of the connector. A pair of lock arms are provided upper and lower sides of the contact sections for supporting the mating connector. It is frequent that the mating connector is attached to a circuit board so that it is desired that the height of the connector be small.

However, the above connector has the lock members on both the upper and lower sides of the contact sections, increasing the height of the connector. The distance between the two lock members is so small that it hardly controls the tilting of the connector when it is plugged with an excessive force.

SUMMARY OF THE INVENTION

Accordingly, it is an object of the invention to provide an electrical connector that is of low profile yet capable of controlling the tilting of the connector upon forced plugging.

According to the invention there is provided an electrical connector which comprises a housing with a plug section having a width which is greater than a height; a plurality of contact elements with contact sections arranged in the plug section in a widthwise direction of the connector; and a pair of protruded sections or indented sections provided on opposite sides of the connector. The guiding members or protruded or indented sections are provided on opposite sides of the connector so that not only the connector is of low profile but also the distance between the guiding members is sufficiently large to control the tilting of the connector in forced plugging.

A shield plate may be provided for covering at least outer side and front faces of the protruded sections for protection, especially, upon forced plugging. A pair of flexible lock members with engaging claws projecting from the housing may be provided in the protruded sections so that it is prevented to increase the dimensions of the connector. The contact elements may be provided with flexible sections so that the contact sections are pushed back to a front face of the housing by contact sections of the mating connector.

A shield plate with opposite sidewalls serving as outer sidewalls of the indented sections may be provided for guiding and supporting side mating connector. The housing may be provided with a plurality of fine grooves for receiving contact sections of the contact elements such that any front corner of the mating connector cannot make contact with the contact sections. The shield plate may be provided so as to surround the plug section and has a flared front inlet portion.

DESCRIPTION OF THE PREFERRED EMBODIMENTS

Embodiments of the invention will now be described with reference to the accompanying drawings.

Figure 1:
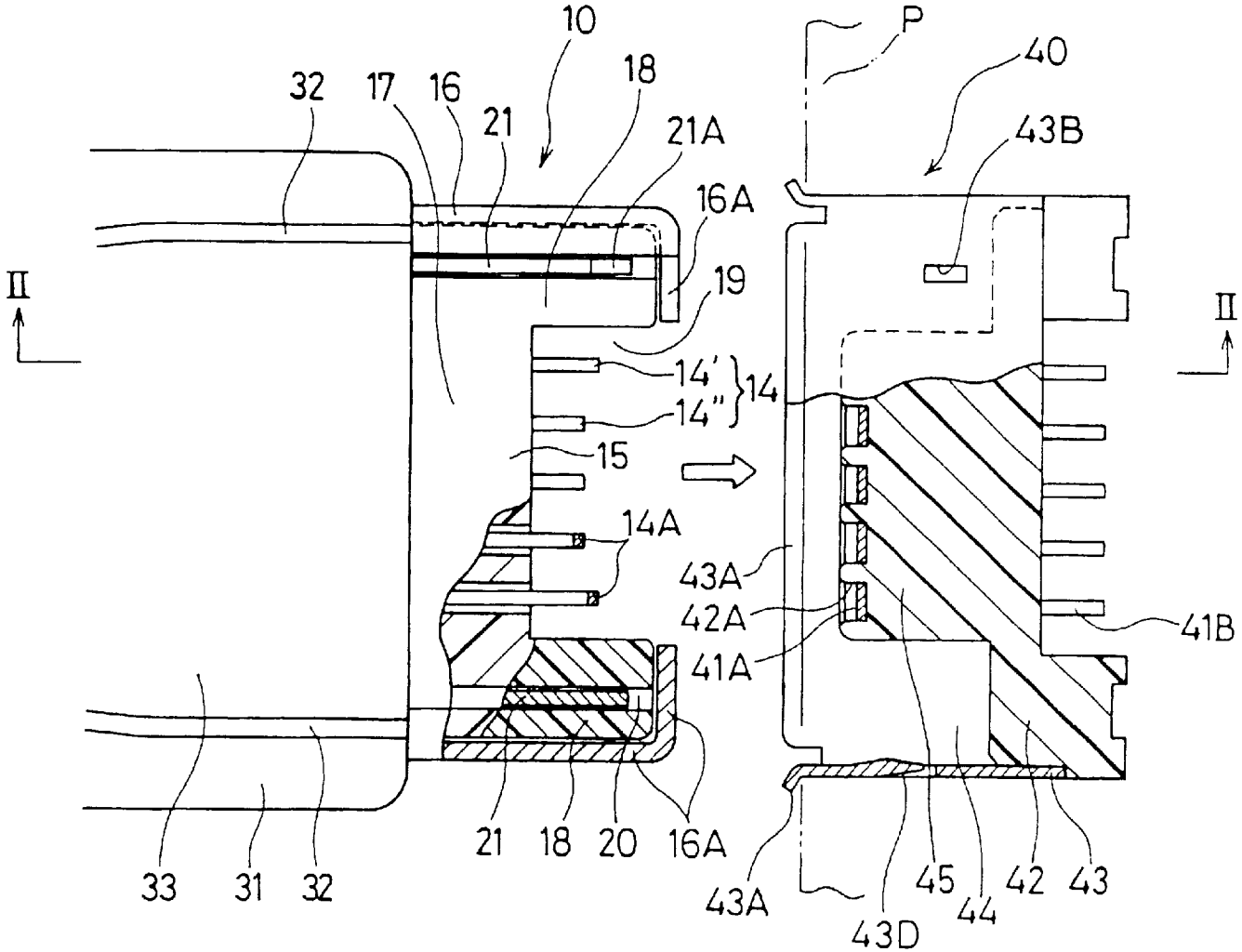
FIG. 1 is a partially cutaway, top plan view of a pair of connectors according to an embodiment of the invention.
Figure 2:
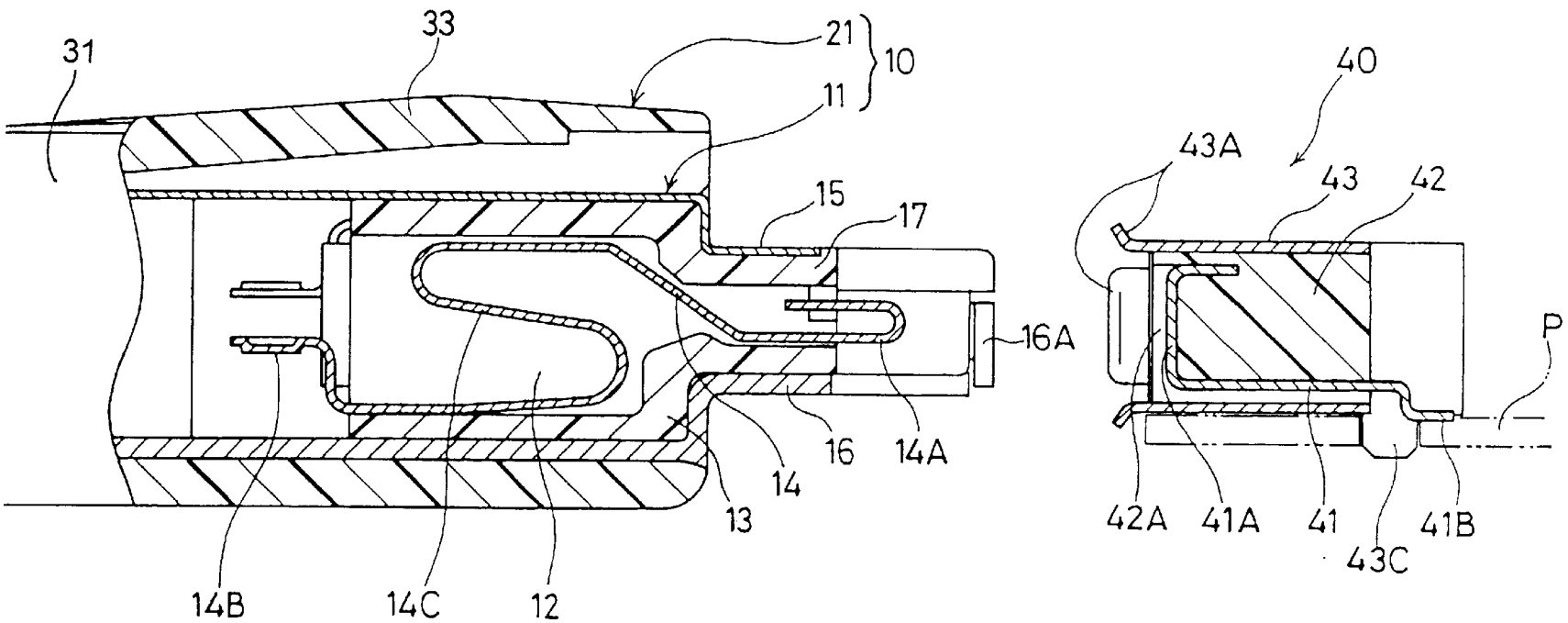
FIG. 2 is a sectional view taken along line II—II of FIG. 1.

In FIGS. 1 and 2, a connector 40 is mounted on a circuit board P, and another connector 10 is plugged into the connector 40. The width of each of the connectors 10 and 40 (in a first direction parallel to the circuit board P and perpendicular to the plugging direction) is made greater than the height thereof (in a second direction perpendicular to the circuit board P).

As shown in FIG. 2, the connector 10 has a connector body 11 and a cover member 31 for accommodating the connector body 11. The connector body 11 comprises a housing body 13 with a plurality of elongated inner cavities 12 provided in the first direction, a plurality of contact elements 14 put in the inner cavities 12, respectively, and a pair of shield plates 15 and 16 provided on the upper and lower surfaces of the housing body 13, respectively.

Figure 3:
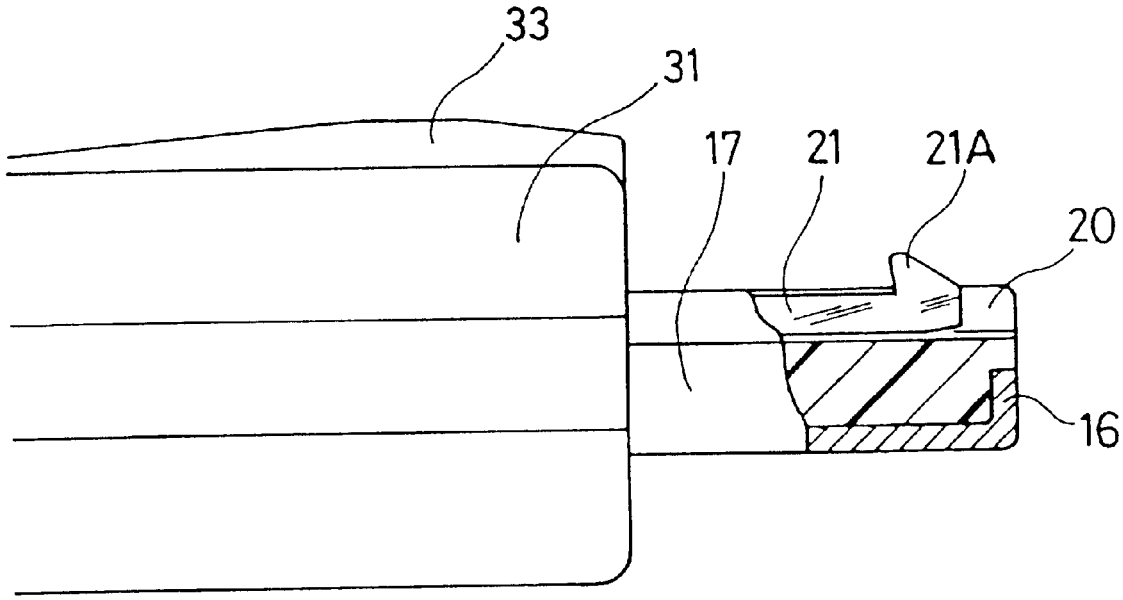
FIG. 3 is a partially cutaway, side elevational view of one of the connectors.

Each inner cavity 12 is enlarged in the second direction for accommodating one of the contact elements 14. The width and height of the plug section 17 are made smaller than those of the housing body 13 so that the inner cavities 12 are made smaller in the second direction in the plug section 17 than in the housing body 13 (FIG. 2). A pair of protruded sections 18 extend forwardly from the plug section 17 to not only form a recess 19 therebetween but also guide plugging with the mating connector 40. A pair of fine grooves 20 are provided on the upper faces of the protruded sections 18 for receiving lock members 21. Each lock member 21 is made substantially flat and has an engaging claw 21A projecting from the upper face of the protruded section 18 (FIG. 3). The engaging claws 21A of the lock members 21 are depressed into the fine grooves 20 by a flexible pressure section 33 that is made by a pair of slits 32 cut in the cover member 31.

The lower shield plate 16 is made thicker than the upper shield plate 15 for providing strength. The shield plate 16 is provided with a protective section 16A made of a metal sheet covering the outer and front sides of the protruded sections 18. Each contact element 14 has a U-shaped front contact section 14A, a connection section 14B projecting rearwardly from the housing body 13, and an S-shaped flexible section 14C between them. The contact elements 14 include long ground contact elements 14' and short signal contact elements 14". The contact sections 14A normally project from the bottom of the recess 19 but when the connector 10 is plugged into the connector 40, they are pushed back to the bottom of the recess 19 by the contact elements of the mating connector 40, with the flexible sections 14C being flexed.

The connector 40 comprises a housing body 42, a plurality of contact elements 41 supported by the housing body 42, and a shield plate 43 fitted over the housing body 42. The housing body 42 has a pair of indented sections 44 for not only receiving the protruded sections 18 but also forming a raised section 45 therebetween where the contact sections 41A of the contact elements 41 are provided for contact with the contact sections 14A when the raised section 45 are put into the recess 19 of the connector 10.

The shield plate 43 extend forwardly a little more than the front face of the raised section 45 and outwardly at the front end to form an inlet section 43A. It forms outer walls of the indented sections 44 to guide and support the protruded sections 18 of the connector 10. A pair of engaging slits 43B are provided in the upper face of the shield plate 43 for engagement with the engaging claws 21A of the connector 10 for making lock. A pair of spring arms 43D are provided on opposite sides of the shield plate 43 for spring contact with the protective sections 16A, thus making shield connection therebetween, when the protruded sections 18 are fitted in the indented sections 44.

A plurality of grooves 42A are provided in the front face of the raised section 45 for receiving the contact sections 41A of contact elements 41. As shown in FIG. 2, the contact sections 41A have sufficient height and width to make contact with the contact sections 14A of the contact elements 14. The width and depth of the grooves 42A are made such that the front end of the connector 10 does not make any contact with the contact sections 41A upon plugging.

The end portions of the contact elements 41 are bent outside the housing body 42 to form connection sections 41B which are to be soldered to traces of circuitry on a circuit board P. The shield plate 43 has a pair of downward legs 43C to be put through apertures of the circuit board P for making connection by soldering.

How to use the connector will be described below.

(1) The connector 40 is attached to the circuit board P.

(2) The cables from other equipment are soldered to the connection sections 14B of the contact elements 14.

(3) The plug section 17 of the connector 10 is plugged into the connector 40 by putting the protruded sections 18 into the indented sections 44 for guidance, when the guiding sections 43A of the shield plate 43 facilitates insertion of the connector 10. When the protruded sections 18 are put in the indented sections 44, the protective section 16A makes spring contact with the spring arms 43D of the connector 40 for making shield connection.

(4) When the plugging is completed, the contact sections 14A of the ground contact elements 14' are pushed back by the contact sections 41A of the contact elements 41, and then the contact sections 14A of the signal contact elements 14"are pushed back by the contact sections 41A of the contact elements 41. Consequently, the ground contact elements and the signal contact elements make sequential contact with the contact elements 41 under a predetermined contact pressure by the spring force of the flexible sections 14C.

(5) The engaging claws 21A of the connector 10 engage the engaging slits 43B of the connector 40 to prevent separation of both the connectors.

(6) To unplug the connector, the pressure member 33 of the connector 10 is depressed to flex the lock members 21 for removing the engaging claws 21A from the engaging slits 43B. Under such conditions, it is possible to unplug the connector 10 from the connector 40.

Figure 4:
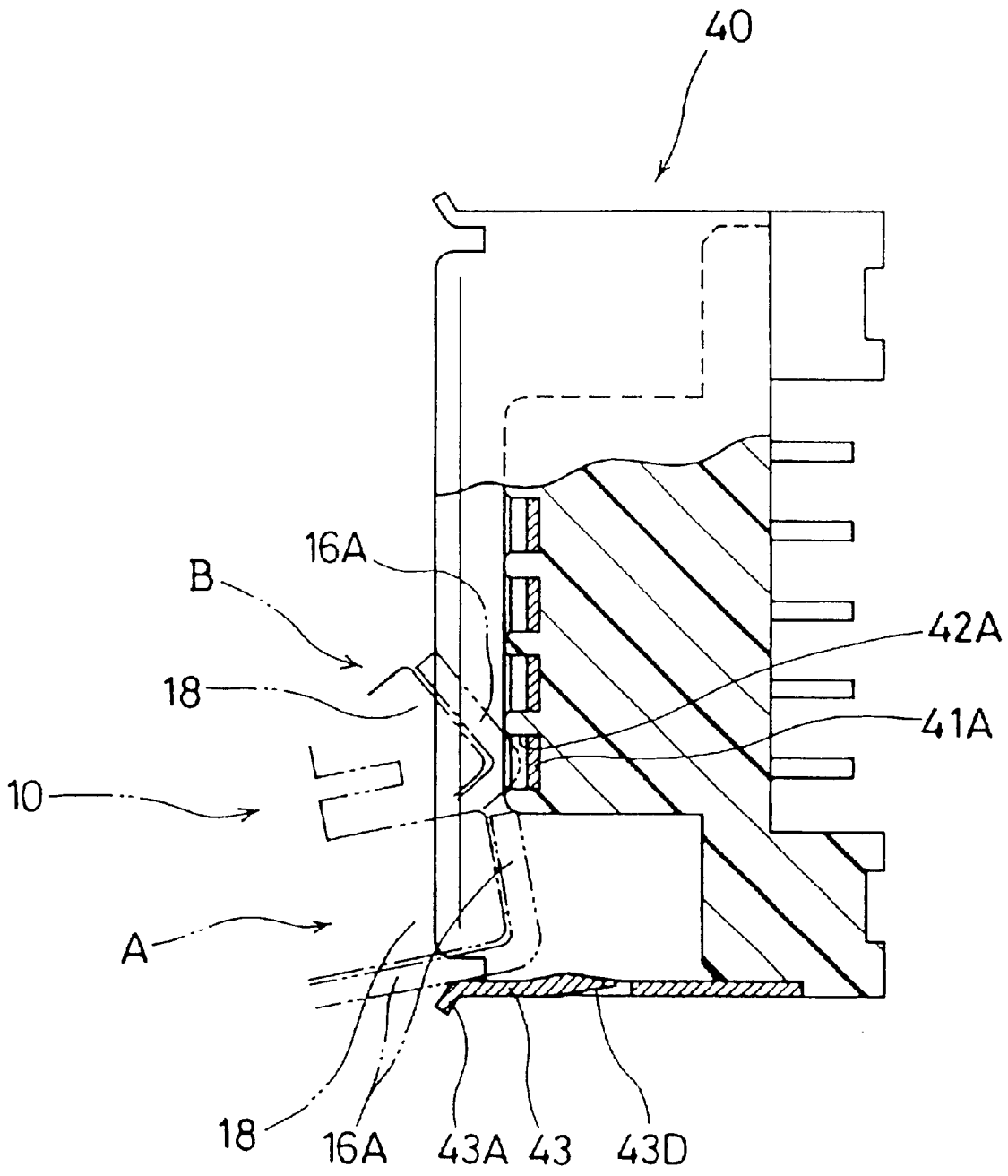
FIG. 4 is a partially cutaway, top plan view of the connectors showing forced plugging at angles.

(7) Where an attempt is made to plug the connectors at an angle with an excessive force, the protruded sections 18 of the connector 10 and the indented sections 44 of the connector 40 cooperate to minimize the angle. For example, even if the connector 10 is tilted or out of position with respect to the connector 40 in a forced plugging operation as shown by phantom lines A or B in FIG. 4, both of the connector 10 and the contact sections 41A are protected by the protective section 16A and in the grooves 42A, respectively.

As has been described above, the connector according to the invention comprises the guiding sections or protruded sections and the indented sections provided on opposite sides of the connector so that not only the height of the connector is minimized but also the tilting of the connector upon plugging is minimized. Part of the shield plate covers the guiding section to protect the connector against forced plugging.

What is claimed is:

1. An electrical connector comprising:

a housing having a plurality of elongated inner cavities provided in parallel with each other and a plug section having a width which is greater than a height;

a pair of protruded sections provided on opposite sides of said connector to form a recess therebetween and having a pair of lock members with engaging claws projecting from said housing in a heightwise direction of said housing;

a plurality of contact elements accommodated in said elongated inner cavities and having contact sections arranged in said plug section in a widthwise direction of said connector and projecting from said plug section into said recess; and a pair of shield plates covering at least outer side and front side of said protruded sections for protection and having a pair of protective sections brought into contact with a shield plate of a mating connector when said connector is inserted into said mating connector.

2. An electrical connector according to claim 1, wherein said contact elements are provided with flexible sections accommodated in said inner cavities so that said contact sections are pushed back to a face of said housing by contact sections of said mating connector.

3. An electrical connector comprising:

a housing with a raised section having a width which is greater than a height;

a pair of indented sections provided on opposite sides of said connector to receive protruded sections of a mating connector;

a plurality of contact elements with contact sections arranged in said raised section in a widthwise direction of said connector and extending in a direction perpendicular to said widthwise direction and a plugging direction of said mating connector at a front end of said raised section; and a shield plate provided at at least an outer side of said indented section for guiding said protruded section of said mating connector and having a pair of spring arms on opposite sides of said shield plate, said spring arms brought into contact with a protective section of a shield plate of said mating connector when said protruded sections of said mating connector are inserted into said indented sections of said connector.

4. An electrical connector according to claim 3, wherein a pair of engaging slits are provided in an upper face of said shield plate for engagement with engaging claws of said mating connector.

5. An electrical connector according to claim 3, wherein said housing has a plurality of fine grooves for receiving contact sections of said contact elements such that any front corner of said mating connector cannot make contact with said contact sections.

* * * * *